US006497542B1

(12) United States Patent
Vermeulen

(10) Patent No.: US 6,497,542 B1
(45) Date of Patent: Dec. 24, 2002

(54) DEVICE FOR SAFE-KEEPING AND TRANSPORTING PIECE GOODS

(75) Inventor: Bart Vermeulen, Wielsbeke (BE)

(73) Assignee: Conteyor Multibag Systems NV, Merelbeke (BE)

( * ) Notice: Subject to any disclaimer, the term of this patent is extended or adjusted under 35 U.S.C. 154(b) by 0 days.

(21) Appl. No.: 09/719,491

(22) PCT Filed: Jun. 14, 1999

(86) PCT No.: PCT/EP99/04088

§ 371 (c)(1),
(2), (4) Date: Mar. 5, 2001

(87) PCT Pub. No.: WO99/65781

PCT Pub. Date: Dec. 23, 1999

(30) Foreign Application Priority Data

Jun. 16, 1998 (DE) ..... 198 26 429

(51) Int. Cl.[7] ..... B60P 7/00
(52) U.S. Cl. ..... 410/43; 410/31; 410/32
(58) Field of Search ..... 410/31, 32, 35, 410/43, 89; 206/583; 211/13.1, 71.01, 85, 180, 195

(56) References Cited

U.S. PATENT DOCUMENTS 1,889,350 A * 11/1932 Cohen-venezian ..... 410/31
2,333,441 A * 11/1943 Reawin et al. ..... 410/43
3,278,042 A * 10/1966 Frydenberg ..... 410/32
5,378,093 A * 1/1995 Schroeder ..... 410/32
5,876,165 A * 3/1999 Campbell ..... 410/43

FOREIGN PATENT DOCUMENTS

DE 4138507 A1 5/1993
DE 19549166 A1 7/1997

* cited by examiner

*Primary Examiner*—Stephen T. Gordon
(74) *Attorney, Agent, or Firm*—Michael L. Dunn

(57) ABSTRACT

The present invention concerns an apparatus for storing and transporting piece goods, in particular articles whose dimensions in at least one or in two mutually perpendicular directions are markedly larger than in the remaining third direction in space, wherein the articles are received in substantially U-shaped pockets which are formed from a flexible web material and which are arranged in a support stand or frame. In order to provide an apparatus having the features set forth hereinbefore, with which the loading and unloading operation is simplified while nonetheless the other advantages of the known apparatuses are retained and the articles are also still accommodated in well-protected or even still better-protected manner, it is proposed in accordance with the invention that the U-shaped pockets are formed by two respective separate substantially parallel-extending material webs comprising the flexible material, wherein at least one respective connecting web of a flexible web material extends between the two material webs and is preferably connected substantially over the entire length thereof to the two adjacent material webs.

22 Claims, 5 Drawing Sheets

DEVICE FOR SAFE-KEEPING AND TRANSPORTING PIECE GOODS

Figure 1:
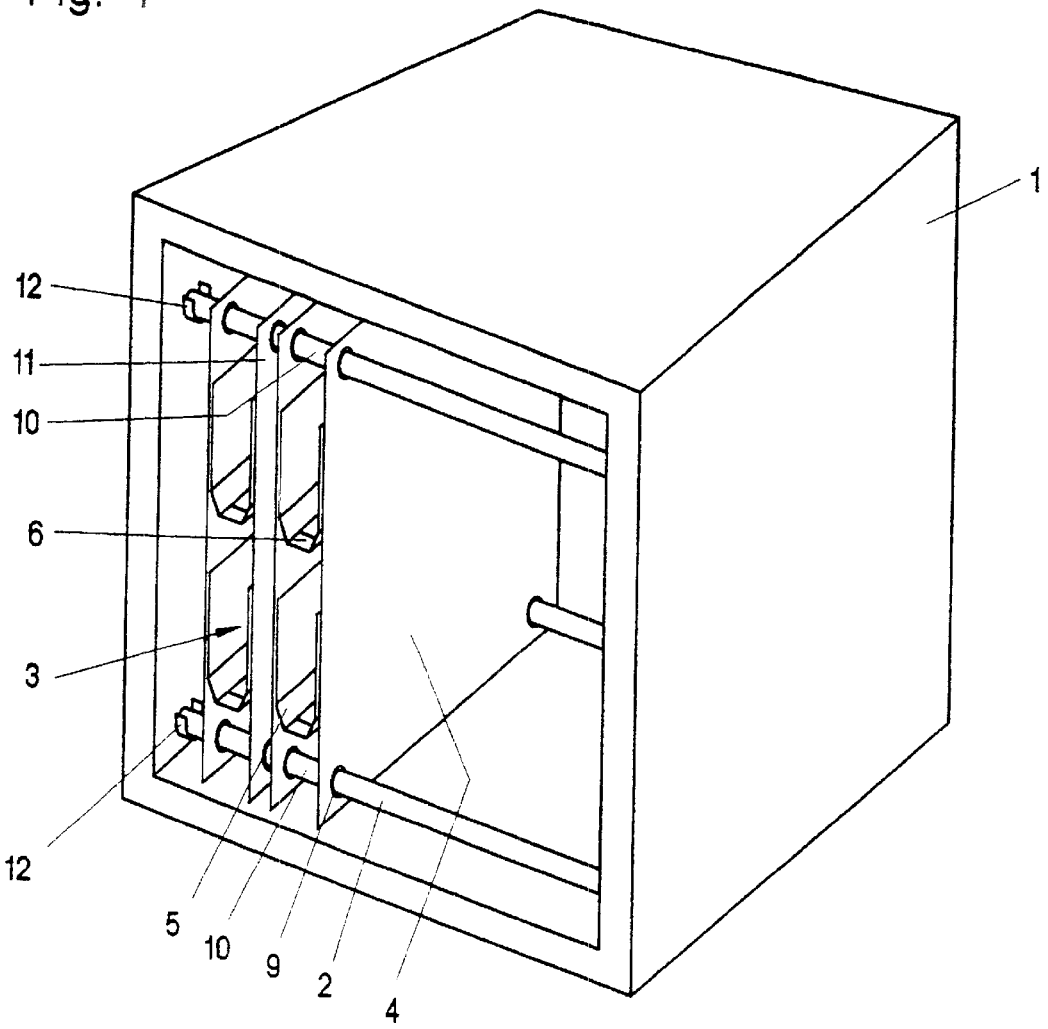

The present invention concerns an apparatus for storing and transporting piece goods, in particular articles whose dimensions in at least one or in two mutually perpendicular directions are markedly larger than in the remaining third direction in space, wherein the articles are received in substantially U-shaped pockets which are formed from a flexible web material and which are arranged in a support stand or frame.

Such an apparatus is known for example from German patent applications Nos. P 41 38 507 and 195 49 166. In the known apparatus the U-shaped pockets are formed by a long web of material which is laid in a plurality of loops which are suspended for example on bars or rods which are arranged at a spacing in succession so that accordingly the web of material is laid transversely over a first bar, extends downwardly and then extends upwardly again in a U-shape, is then laid over the next bar, and so forth. The portions which are hung over the bars can be sewn off in that case so that they form the closed loops, through which the carrier bars extend so that the web of material also cannot slip on the bars in the longitudinal direction thereof and thus the U-shaped pockets are always of the same length or depth. The web of material can also be suspended on additional loops which are specifically disposed on the web of material.

Such apparatuses are used for example for storing and transporting individual components in automobile manufacture, for example bodywork parts, door claddings and other components which are generally more or less two-dimensional articles, that is to say articles which are of relatively large dimensions in at least one but in most cases two mutually perpendicular directions, in comparison with the third remaining direction. That applies for example in relation to the doors, door claddings, engine hoods or bonnets, wings and other parts of motor vehicles.

Corresponding apparatuses for storing and transporting components of that kind which are comparatively sensitive to impact and scratching are intended for transporting and also storing the corresponding components as inexpensively as possible, that is to say without expensive packaging means. Depending on the respective configuration involved the corresponding apparatuses are relatively simple to load and unload, they are re-usable and, if no articles are being transported therein, depending on the respective apparatus configuration, they can also be collapsed or folded down to constitute a compact structure.

In order to deal carefully with and protect the articles transported in such apparatuses the webs of material usually comprise a relatively soft, flexible cloth which for example can be a woven fabric or a fleece-like material and which can possibly also comprise a plastic web with embossing or shaped portions thereon.

If the corresponding articles are relatively large and comparatively thin, the U-shaped pockets into which the articles are inserted either from above between two bars or however laterally into the ends, which are open at that position, of the U-shaped pockets, must be of a correspondingly large vertical (and possibly also horizontal) depth. Then, between two adjacent bars on which the two ends of such a U-shaped pocket are suspended, a relatively long piece of material web hangs loosely down, forming the U-shaped loop.

As the material web must be relatively soft and flexible to protect and deal carefully with the articles to be transported or stored, with the material webs hanging down loosely the oppositely disposed web portions can relatively easily deform or form folds, which can have the result that the two portions of a U-shaped pocket, which form the limbs of the U-shape, bear against each other so that the corresponding pocket, at least at one of its ends or in parts of said ends, is no longer open and readily accessible. In many situations of use however loading and unloading of those apparatuses precisely from the end of the pockets is preferred in particular for the reason that, because of their size, the pockets have to be suspended at such a height in the corresponding frames or support stands that, when the support stand in question is simply standing on the ground or on a pallet, the pockets are accessible for the personnel loading or unloading the apparatuses, at the best from the side, that is to say from the ends of the pockets in question, and not from the top between the carrier bars.

If however the webs suffer deformation and come to bear against each other because of their flexibility, then at any event loading of such an apparatus is made considerably more difficult, because a person who then wants to insert an article into that pocket firstly has to open the pocket, that is to say that person has to separate from each other the portions which are bearing against each of the webs of material, in order to be able to insert an article into that pocket. That is particularly tiresome if the person needs both hands to support the article and introduce it into the pocket, which can then mean that the article firstly has to be put down, then the pocket in question has to be opened so that it is only after this that the article can be picked up again and inserted into the pocket, in which case the pocket can then independently close again if it is not specifically held open.

There is also the danger of damage or scratching occurring, when the article is being put down.

A further disadvantage of the known apparatus is that adjacent pockets each jointly use a respective suspension bar so that accordingly all U-shaped pockets are immediately adjacent and are connected together by virtue of the common material web from which they are formed. There is then practically no possibility of also arranging additional damping and packaging material between the pockets as in particular the web portions of adjacent pockets, which hang down over the same bar, generally bear directly against each other. Admittedly, those material webs could certainly be separated from each other, but that again requires additional handling operations.

The U-shaped pockets which are only suspended at their upper end also have the troublesome inclination to swing about for example when being transported in a truck or other wagon or carriage, in particular when heavy articles are accommodated in those pockets. Due to those swinging movements the pockets can knock against each other or also against the frame of the support stand, and that then, in spite of being covered by the web of material, can result in damage to the articles accommodated therein.

In comparison with that state of the art the object of the present invention is to provide an apparatus having the features set forth in the opening part of this specification, in which the loading and unloading procedure is simplified and nonetheless the other advantages of the known apparatuses are retained and the articles are also still accommodated in a well-protected or even better-protected manner.

That object is attained in that the U-shaped pockets are formed by two respective separate substantially parallel-extending material webs comprising the flexible material, wherein at least one respective additional connecting web of a flexible web material extends between the two material webs and is respectively connected substantially over the entire length thereof to the two adjacent separate material webs.

An essential difference in relation to the known apparatus therefore is that it is not for example a continuous material web that is suspended in a U-shape that forms the pocket in question, but there are provided two substantially flat webs of a flexible material, which are suspended at a spacing separately in relation to each other and which are then connected together by an additional connecting web so that the result in principle is a U-shape in a cross-section perpendicularly to the two parallel material webs and perpendicularly to the plane defined by the connecting web. In this case the parallel or perpendicularly downwardly hanging, separate material webs do not necessarily have to be connected together at their lower ends by the connecting web, but this can also happen in a somewhat higher region. In particular also a plurality of connecting webs can connect the two separate material webs together at a spacing and in substantially mutually parallel relationship so that for example there are formed a plurality of mutually superposed pockets which are each of a U-shaped cross-section and which can be closed by an additional connecting web at their top side, for example by the connecting web of a U-shaped pocket which is arranged thereabove and which so-to-speak supplements the existing U-shaped cross-section to form a=-cross-section.

By virtue of the fact that the separate material webs generally hang down perpendicularly and are only connected together by an additional connecting web, they are more easily held at a spacing relative to each other and no longer have a tendency to come to bear against each other and thereby close the open ends of the U-shaped pockets.

The connecting webs may also have an inlay or insert of a somewhat less flexible material such as for example a thin plastic plate or a somewhat thicker plastic foil or sheet which extends for example substantially along the entire connecting web and which further substantially enhances the effect of holding the two separate material webs apart. Moreover the connecting webs do not necessarily have to extend horizontally between the perpendicularly hanging, separate material webs but they can also extend for example inclinedly relative to the horizontal or they may even extend vertically between the material webs so that the U-shaped cross-section of the pockets occurs substantially only in a horizontal section. The connecting web can be so disposed between the two other material webs and connected thereto that, considered in itself, it also in turn forms the shape of a U, but it can also be in the form of an "S" connecting together the two adjacent material webs which hang down substantially flat.

The spacing of the connecting locations which preferably extend over the entire width or depth of the pockets may be markedly less than the overall width of the connecting web between the mutually oppositely disposed fixing locations. That applies in particular if the connecting web has the above-mentioned inlay or insert which then defines a normal spacing width between the two perpendicularly downwardly hanging material webs, but which if necessary can be enlarged to the full width of the connecting web between the fixing regions thereof.

The connecting web can either be sewn, glued or welded to the two parallel material webs. The only essential consideration is a strong connection which is capable of bearing loads as articles which under some circumstances are relatively heavy in weight are to be accommodated in the pockets.

In the preferred embodiment of the invention the width of the connecting web between its fixing regions to the two adjacent material webs is greater than the spacing between the material webs which are connected thereby, in their normal position which is intended for transportation or storage of articles. It will be appreciated that the width of the connecting web is adapted to the maximum depth of the articles to be accommodated in the U-shaped pockets and is possibly greater than the maximum dimensions of the articles to be accommodated, in the third direction in space as referred to above.

In this case however the flexible material webs may adapt to the shape of the articles to be accommodated and may possibly bulge out to a greater or lesser degree in the region of projections on the articles, possibly even beyond the width of the connecting web. The above-mentioned somewhat stiffer insert or inlay which is to be provided in the connecting web is preferably of a width which is markedly less than the total width of the connecting web between the fixing regions thereof.

The material webs are preferably suspended at their upper corners and if possible are also suspended or guided at their front lower corner. In that way it is possible for the web to be more or less tensioned between at least three points and thereby held substantially flat in its position. In the case of material webs which are particularly wide and thus for example can receive articles from two opposite sides in a correspondingly wide U-shaped pocket, in which case there may also be a vertical partition between those articles within the pocket, the web of material is preferably also suspended at the rear corner or overall at all four corners, in which case in addition a suspension means may also be provided at the centre of the upper edge.

Particularly preferred is a design configuration of that suspension arrangement in the form of eyes which are incorporated into the material web and which are guided on rods or bars which extend in the support stand or frame in mutually parallel relationship at the mutual spacing that the corresponding eyes also have from each other on the web when in the spread-out condition.

The corresponding frame should be open either at the top or laterally in order to make the U-shaped pockets correspondingly accessible from above or from the side and possibly also from both opposite sides.

The bars on which the eyes of the material webs are guided are desirably fitted into a collapsible frame. That makes it possible for the bars with the material webs to be removed from their condition of being suspended in the frame, and possibly also for the bars to be pulled out of the eyes and for the material webs to be arranged in a closely packed stack, in which case the frame is also collapsed so that the empty apparatus, in that collapsed condition, takes up only very little space.

When the material webs are arranged in the support stand or frame, spacers can be provided between adjacent material webs, more specifically both between the material webs which with a respective connecting web jointly form a respective pocket and also between adjacent material webs which each belong to another respective U-shaped pocket. In particular also cushion material can be disposed in that intermediate space so that possibly hard but sensitive or delicate articles in adjacent U-shaped pockets are very well cushioned relative to each other.

In such an embodiment with the cushioning option, it is desirable if the material webs are provided only in interconnected relationship in pairs by means of connecting webs so that cushion material and the articles to be transported or stored are respectively arranged alternately between successive material webs, the latter each in the respective U-shaped pockets formed by two material webs.

It is however also possible for a material web to be provided on respective ones of both sides with a connecting web and for the free end of that connecting web then to be connected to a respective further material web, in which case this can also be further continued until the result achieved is a desired number of interconnected material webs, wherein, with the exception of the two outermost material webs, all inner material webs belong to two respective adjacent U-shaped pockets.

It is further desirable if, when using a corresponding frame or support stand in which the material webs are accommodated, all open sides of the frame or support stand are closable by a further material web or a curtain which extend substantially perpendicularly to the parallel material webs of the U-shaped pockets.

Figure 2:
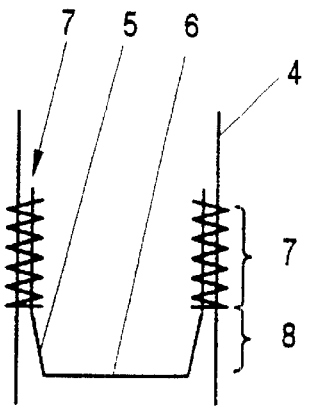
Figure 3:
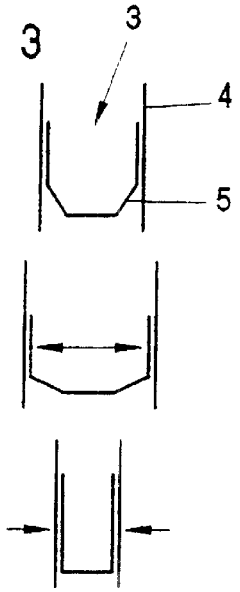
Figure 4:
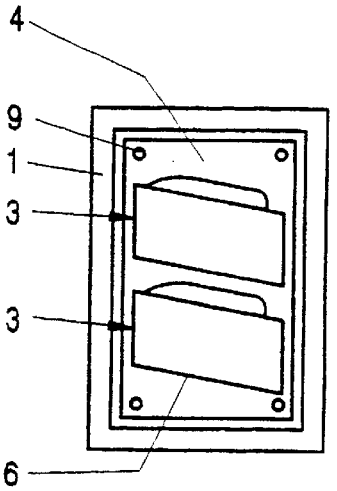
Figure 5:
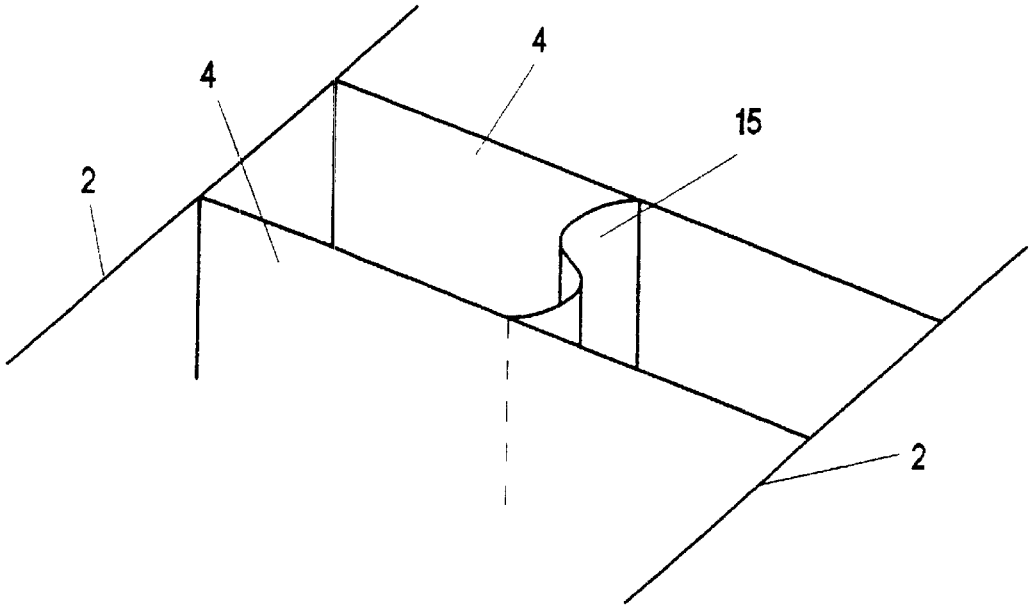
Figure 6:
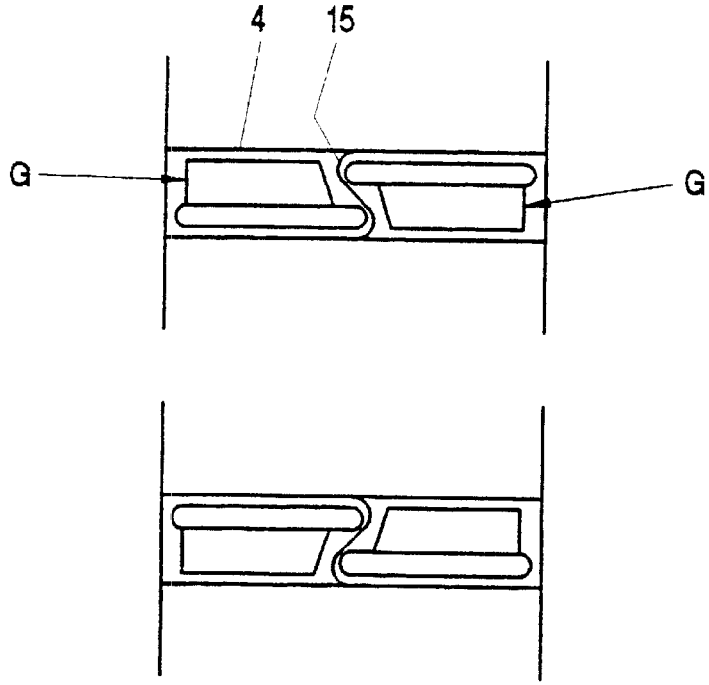
Figure 7:
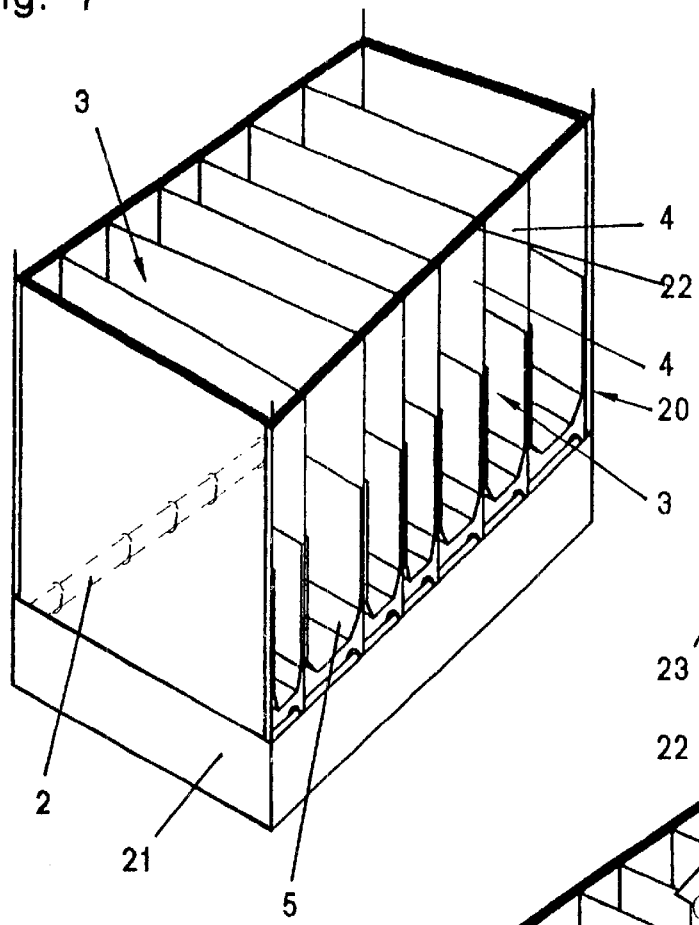
Figure 8:
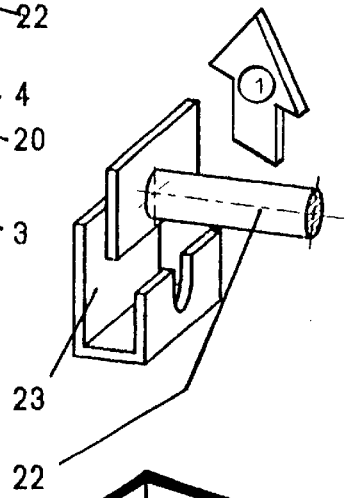
Figure 9:
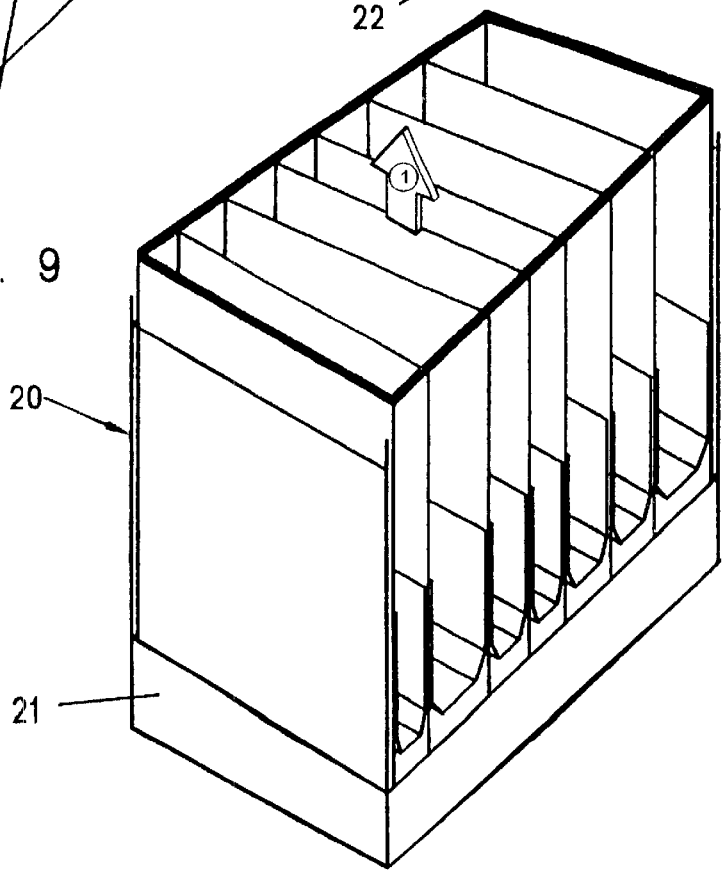
Figure 10:
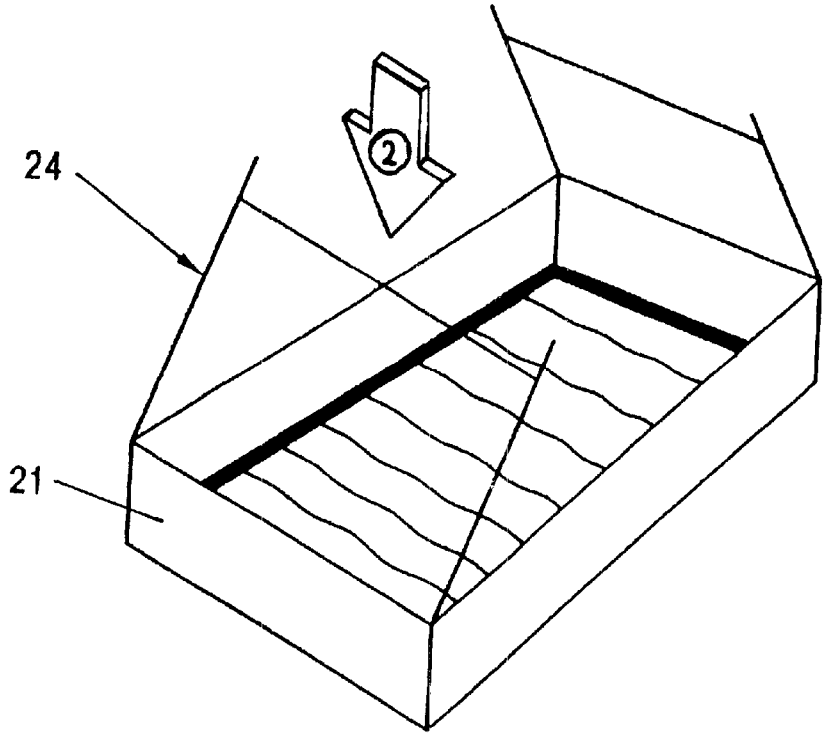
Figure 11:
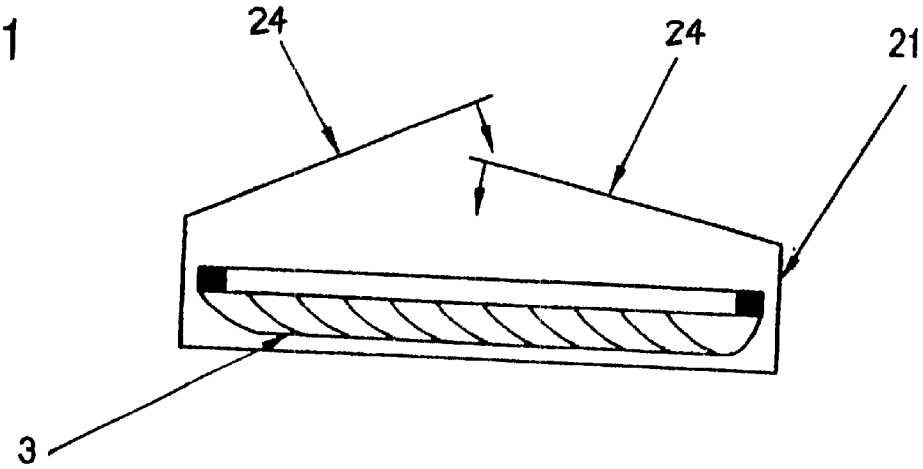
Figure 12:
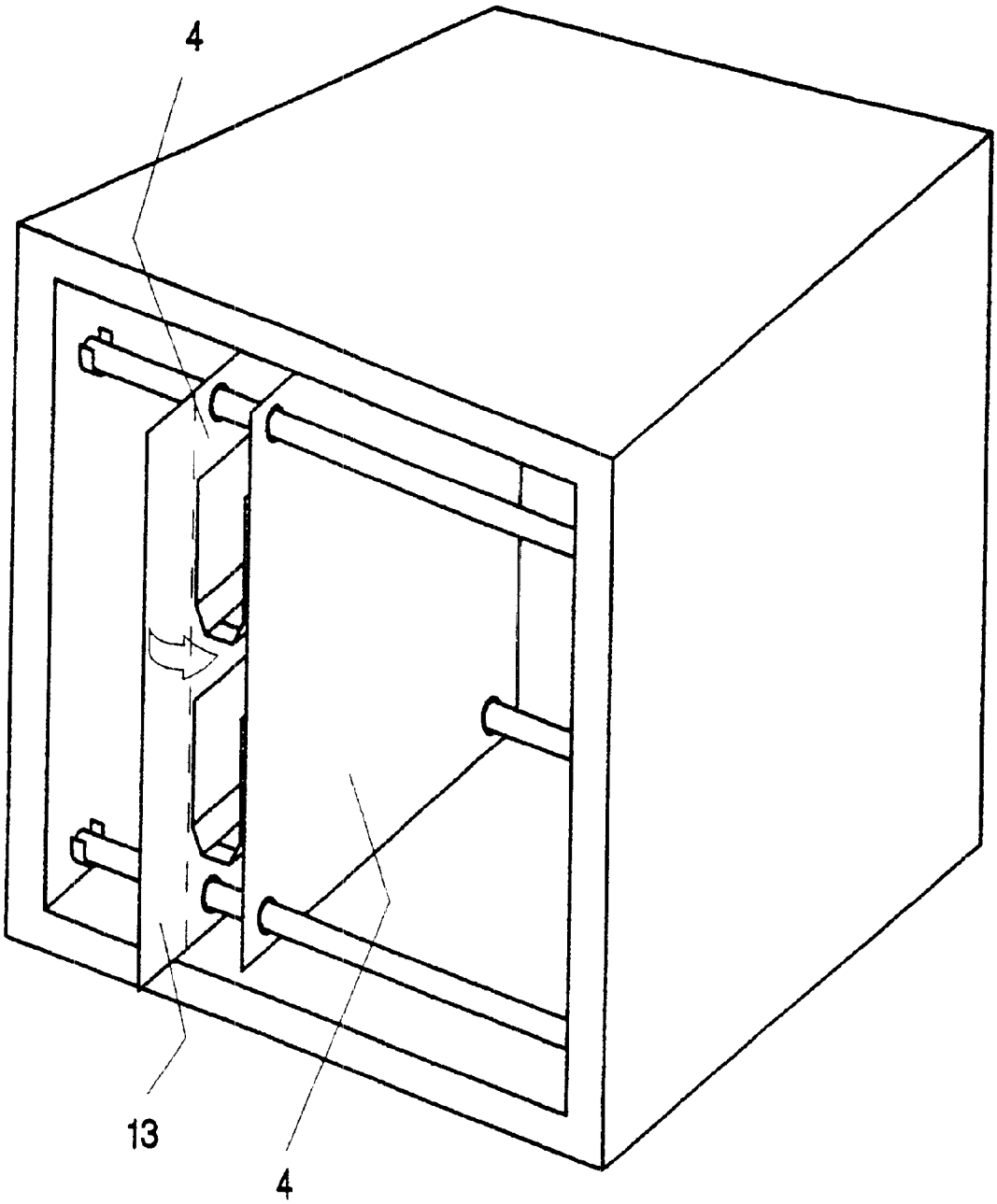

Further advantages, features and possible uses of the present invention will be clearly apparent from the following description of a preferred embodiment and the accompanying drawings in which:

FIG. 1 shows a perspective view of a transport and storage apparatus according to the invention, FIG. 2 is a view in section through a U-shaped pocket with a connecting web sewn thereto in a U-shape, FIG. 3 shows the various width settings of the U-shaped pockets 3 of the embodiment shown in FIG. 2, FIG. 4 diagrammatically shows a side view of the apparatus, also illustrating the position of the U-shaped pockets 3 and the lower edge thereof in the form of the inserts or inlays 6, FIG. 5 shows an S-shaped connecting web for forming a vertical division in a U-shaped pocket, FIG. 6 diagrammatically shows articles G being received in the pockets formed as shown in FIG. 5, FIG. 7 shows a system of U-shaped pockets suspended in a collapsible frame, FIG. 8 shows a detail of the bar suspension arrangement in the embodiment shown in FIG. 7, FIG. 9 shows the first step in collapsing or dismantling the apparatus shown in FIG. 7, FIGS. 10 and 11 diagrammatically show the further steps in the procedure involved in collapsing the apparatus shown in FIG. 7, and FIG. 12 shows a further variant of the embodiment described with reference to FIGS. 1 to 4.

Referring to FIG. 1 shown therein is a box 1 which, with the exception of its front side which is visible at the front on the left, is closed at all other sides. It would also be possible however for the side which is opposite the open side also to be open.

Extending parallel to the lower and upper edges of the open side are rods or bars or tubes 2 which are suspended in bar holders 12 which in turn are fixed to the housing wall of the box 1. Corresponding bars 2 also extend in the proximity of the closed rear wall, in the proximity of each of the upper and lower edges.

The bars 2 carry flexible material webs 4 which are of a substantially rectangular shape and which in their corner regions have respective eyes 9 which are pulled onto the bars 2. In that case the spacing of the bars 2 relative to each other and the spacing of the eyes 9 on the webs 4 relative to each other is in each case such that the material webs 4 can hang down loosely from the upper bars 2 or are slightly tensioned so that the material webs 4 form substantially flat, level material webs. Spacers 10 in the form of short tube portions are also pulled onto the bars 2 between the individual material webs 4, with the outside diameter of the tubular spacers 10 being larger than the inside diameter of the eyes 9 so that the spacers hold the material webs 4 which are adjacent in that way at a fixedly predeterminable spacing.

Sewn in position between each two adjacent material webs 4 are respective U-shaped connecting webs 5 which, together with the vertically extending webs 4 which are also referred to hereinafter as separating webs, form U-shaped pockets. In the embodiment illustrated in FIG. 1, two respective connecting webs 5 are sewn in position at a spacing one above the other between each two respective adjacent separating webs 4 so that two mutually superposed U-shaped pockets 3 are formed between each two respective separating webs 4.

The connecting webs 5 also have inserts or inlays 6 of a somewhat less flexible material, for example in the form of a thin plastic plate. These inlays 6 ensure that, as can be clearly seen from FIG. 2, the U-shaped pockets 3 have a flat bottom in the form of those inserts 6. In that way the U-shaped pockets are held open not only by the spacers 10 which hold the separating webs 4 at a spacing from each other, but also by the inserts 6.

The inserts can extend in respect of depth over the entire length of the connecting web 5, but they can also be relatively short and can be essentially restricted to the lateral opening region of the pockets 3.

Preferably the width of the connecting web 5, measured between the seam regions 7 and including the freely downwardly hanging regions 8 and the portion which is under the insert 6, is at least twice as great as the width of the insert 6. That means that the insert 6, even it is fixedly connected to the connecting web 5 and for example inserted into a pocket in the connecting web 5, can be folded up and laid flat between the separating webs 4.

FIG. 3 clearly shows how the width of the pockets 3 can be varied, insofar as the separating webs 4 can be pulled away from each other or pushed together to a greater or lesser extent, which could be effected on the one hand by altering the length of the spacers, but on the other hand also by virtue of the articles inserted into the pockets 3 being of suitable dimensions.

Additional partitioning walls 11 which for example comprise foam material or another cushion material can also be inserted between a respective pair of separating webs 4 which are connected together by connecting webs 5 and the next pair of separating webs 4 which are also connected by a pair of connecting webs 5.

FIG. 4 is a side view showing that the bottom in the form of the inserts 6 of the individual pockets 3 does not necessarily have to extend horizontally but can also extend inclinedly in a rising or falling position. That can make it easier to carry out operations for loading and unloading articles laterally into and out of the U-shaped pockets 3 which are open at their ends.

FIG. 5 shows between two separating webs 4 a connecting web 15 which is not mounted in the form of a U-shape to the connecting webs but which extends in a substantially S-shape. In the example shown in FIG. 5 the connecting web 15 extends substantially vertically but, like the connecting webs 5 which are disposed in a U-shape, it could equally well extend horizontally or inclinedly. In regard to the separating webs 4 which are only diagrammatically shown in respect of part thereof in FIG. 5, in addition to the vertical connecting web 15 which results in the formation of U-shaped pockets, in respect of which the bottom or the transverse bottom portion of the U-shape extends vertically in the form of the connecting web 15, it is also additionally possible to provide the substantially horizontally or inclinedly extending connecting webs, for example the U-shaped connecting webs 5, thereby affording U-shaped pockets having a corresponding horizontal or inclined bottom, as are shown in FIG. 1, but which in addition also have a vertical closure means in the form of the connecting web 15.

FIG. 6 clearly shows how articles G can be inserted into the corresponding U-shaped pockets from both open ends thereof, wherein in this case the flexible connecting web 15 is adapted in an S-shape to the contours of the articles G. The formation of that contour is also facilitated by virtue of the connecting web 15 being sewn on, welded in position or glued in place, in the S-shape.

FIG. 7 shows a further embodiment of the present invention with a collapsible frame 20. The frame 20 stands on a shallow box 21 and carries a series of separating webs 4 which are connected together by connecting webs 5 and thus form respective U-shaped pockets. In the case of the frame which is used here, those pockets are open both from above and also from the ends thereof. The other sides of the frame however can also be covered over by further flexible web materials or plates or panels, just as the sides which are open for loading and unloading can in principle also be closed by a curtain or other flexible material web or a plate or panel.

The individual elements are shown in FIGS. 7 to 11 which concern this embodiment, only in roughly diagrammatic form and not in detail. In this case moreover all separating walls 4 with the exception of the first and last separating walls or webs are connected on respective ones of both sides by way of a connecting web 5 to the separating web 4 which is next to it on that side so that all U-shaped pockets 3 in this embodiment are fixedly joined together.

FIG. 8 shows a detail of the suspension of the bars 22 in a suitable holder 23, in which respect, as already described hereinbefore, the individual separating webs 4 have in their upper corner regions eyes which are pulled onto the bars 22. It will be seen that the bar 22 is suspended in its holder 23 in such a way that it can be removed therefrom upwardly, in which respect locking elements which secure the bar 22 in the holder 23 during transportation of the apparatus are not shown here.

As illustrated in FIG. 9 the entire group of U-shaped pockets which are suspended on two oppositely disposed bars 22 can be correspondingly lifted in the frame 20 or lifted out of the holders 23 which are fixed to frame members 24 (see FIG. 10). When the bars 22 are lifted out of their holders 23, the individual side elements 24 of the frame 20 can be moved towards each other, as is shown in FIG. 10. The easiest procedure in this case is that firstly the bars 22 with the pockets 3 (in this case generally being empty) hanging thereon are lifted into the position shown in FIG. 9, whereupon the frame members 24 which can be seen in FIG. 10 are firstly pivoted away somewhat outwardly and then the bars 22 with the separating webs 4 hanging thereon are lowered into the box 21. As the separating webs 4 and the connecting webs 5 comprise a flexible material, when that happens the U-shaped pockets 3 are laid in mutually superposed relationship in a folded condition in the box 21. When all pockets 3 with the bars 22 are accommodated in the box 21, the frame members 24, as shown in FIGS. 10 and 11, are folded inwardly so that the entire apparatus is then collapsed in a very compact structure and can be better stowed and transported.

Finally FIG. 12 also shows an embodiment which is very similar to that in FIG. 1, with the single difference that each second one of the separating walls 4 is extended beyond the end edge which can be seen at the front thereof, and thereby has a flap 13 of a flexible but sufficiently stiff material to be folded over hinge-like at the level of the front edge of the adjacent separating web 4 and thus close the open end of the U-shaped pockets after the loading operation. The flap or strip 13 could also be joined to the connecting web 5 or 15 and accordingly could be folded upwardly or downwardly.

The edge of the adjoining separating web 4 and also the flap 13 can each be provided for example with hook-and-loop or touch-and-close fastener material so that after the closing operation the flap 13 also remains in the closed condition.

What is claimed is:

1. An apparatus for storing and transporting articles having a dimension in at least a first direction that is larger than at least one other dimension in a direction perpendicular the first direction, said apparatus comprising substantially U-shaped pockets which are formed from a flexible web material and which are arranged in a frame, wherein each of the U-shaped pockets are formed by two adjacent separate substantially parallel-extending material webs comprising the flexible material, and wherein at least one connecting web of the flexible web material extends between the two parallel material webs to form the U-shaped pocket and wherein the parallel material webs are substantially rectangular and have two upper corners by which they are suspended in the frame.

2. Apparatus according to claim 1 wherein the connecting web is mounted to the two parallel material webs so that the configuration thereof in cross-section is substantially S-shaped.

3. Apparatus according to claim 1 wherein the connecting web is so mounted to the parallel material webs so that the configuration thereof in cross-section is substantially U-shaped.

4. Apparatus according to claim 3 wherein the connecting web extends in a substantially vertical direction between the two material webs which are also oriented vertically.

5. Apparatus according to claim 2 wherein the connecting web extends at an angle to the parallel material webs which are oriented substantially vertically.

6. Apparatus according to claim 1 wherein the connecting web is sewn to the parallel material webs.

7. Apparatus according to claim 1 wherein the connecting web is glued to the parallel material webs.

8. Apparatus according to claim 1 wherein the connecting web is welded to the parallel material webs.

9. Apparatus according to claim 1 wherein the width of the connecting web between the parallel material webs is greater than a dimension of the articles to be accommodated between the parallel material webs.

10. Apparatus according to claim 1 wherein the parallel material webs are suspended at four corners and additionally in the central region of an upper edge of the webs in the frame.

11. Apparatus according to claim 1 wherein the parallel material webs are suspended in the frame so that spaces between the parallel material webs are accessible from above.

12. Apparatus according to claim 1 wherein the parallel material webs are suspended on transverse bars through eyes in the material web.

13. Apparatus according to claim 1 wherein the bars are hung in the frame and the frame is a collapsible frame.

14. Apparatus according to claim 1 wherein spacers are provided between adjacent parallel material webs.

15. Apparatus according to claim 12 wherein spacers are provided between adjacent parallel material webs.

16. Apparatus according to claim 1 wherein the frame is collapsible.

17. Apparatus according to claim 1 wherein the parallel material webs are provided in mutually interconnected relationship only in respective pairs by connecting webs.

18. Apparatus according to claim 1 wherein more than two parallel material webs are interconnected by connecting webs between adjacent parallel material webs.

19. Apparatus according to claim 1 wherein the connecting web has a substantially flat insert comprising a material which is less flexible than the material of the connecting web and the parallel material webs.

20. Apparatus according to claim 1 wherein open sides of the substantially U-shaped pockets are closable by a curtain.

21. Apparatus according to claim 1 wherein open sides of the substantially U-shaped pockets are closable by further material webs extending perpendicularly to the separate material webs.

22. Apparatus according to claim 1 wherein a cushion material is arranged between adjacent parallel material webs which are not connected by a connecting web.

* * * * *

UNITED STATES PATENT AND TRADEMARK OFFICE

CERTIFICATE OF CORRECTION

PATENT NO. : 6,497,542 B1
DATED : December 24, 2002
INVENTOR(S) : Bart Vermeulen It is certified that error appears in the above-identified patent and that said Letters Patent is hereby corrected as shown below:

Column 8,
Line 62, change the dependency of Claim 13 from "1" to -- 12 --.

Signed and Sealed this

Fifteenth Day of April, 2003

JAMES E. ROGAN
*Director of the United States Patent and Trademark Office*

US006497542C1

(12) EX PARTE REEXAMINATION CERTIFICATE (7257th)

United States Patent

Vermeulen

(10) Number: US 6,497,542 C1

(45) Certificate Issued: Dec. 22, 2009

(54) DEVICE FOR SAFE-KEEPING AND TRANSPORTING PIECE GOODS

(75) Inventor: Bart Vermeulen, Wielsbeke (BE)

(73) Assignee: Conteyor Multibag Systems N.V., Merelbeke (BE)

Reexamination Request:
No. 90/009,189, Jul. 25, 2008

Reexamination Certificate for:

| | |
|---|---|
| Patent No.: | **6,497,542** |
| Issued: | **Dec. 24, 2002** |
| Appl. No.: | **09/719,491** |
| Filed: | **Mar. 5, 2001** |

Certificate of Correction issued Apr. 15, 2003.

(22) PCT Filed: Jun. 14, 1999

(86) PCT No.: PCT/EP99/04088

§ 371 (c)(1),
(2), (4) Date: Mar. 5, 2001

(87) PCT Pub. No.: WO99/65781

PCT Pub. Date: Dec. 23, 1999

(51) Int. Cl.
*B60P 7/00* (2006.01)

(52) U.S. Cl. ..... 410/43; 410/31; 410/32

(58) Field of Classification Search ..... 410/43, 410/31, 32

See application file for complete search history.

(56) References Cited

U.S. PATENT DOCUMENTS

| | | | |
|---|---|---|---|
| 5,725,118 | A | 3/1998 | Slager et al. |
| 5,725,119 | A | 3/1998 | Bradford et al. |

FOREIGN PATENT DOCUMENTS

| | | |
|---|---|---|
| FR | 2723916 A1 | 3/1996 |
| WO | 9310024 | 5/1993 |

*Primary Examiner*—Matthew C. Graham

(57) ABSTRACT

The present invention concerns an apparatus for storing and transporting piece goods, in particular articles whose dimensions in at least one or in two mutually perpendicular directions are markedly larger than in the remaining third direction in space, wherein the articles are received in substantially U-shaped pockets which are formed from a flexible web material and which are arranged in a support stand or frame. In order to provide an apparatus having the features set forth hereinbefore, with which the loading and unloading operation is simplified while nonetheless the other advantages of the known apparatuses are retained and the articles are also still accommodated in well-protected or even still better-protected manner, it is proposed in accordance with the invention that the U-shaped pockets are formed by two respective separate substantially parallel-extending material webs comprising the flexible material, wherein at least one respective connecting web of a flexible web material extends between the two material webs and is preferably connected substantially over the entire length thereof to the two adjacent material webs.

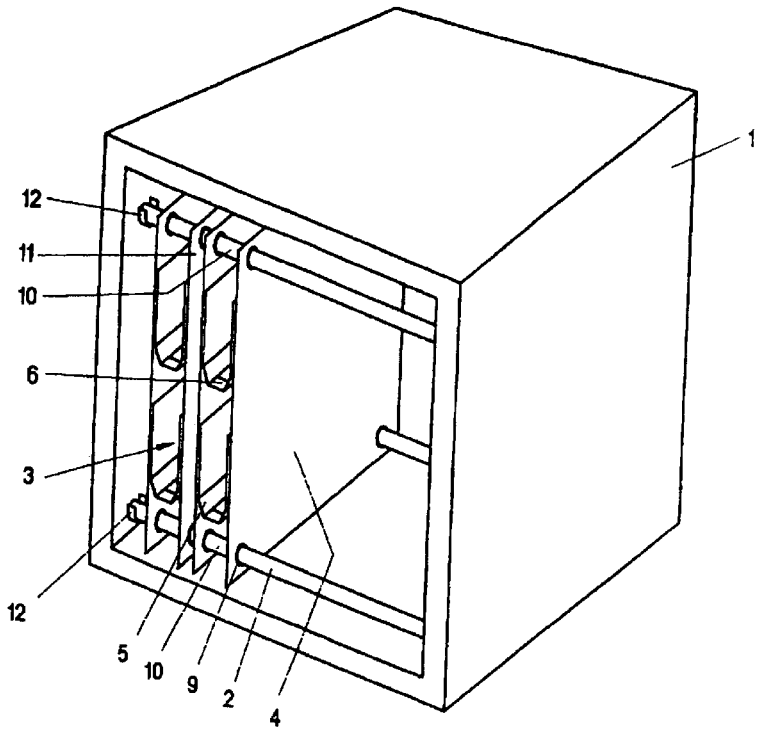

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4, 6, 9, 11–17, 19 and 20 are cancelled.

Claims 5, 7, 8, 10, 18, 21 and 22 were not reexamined.

* * * * *